United States Patent [19]

Lovie et al.

[11] Patent Number: 4,715,935

[45] Date of Patent: Dec. 29, 1987

[54] PALLADIUM AND PALLADIUM ALLOY PLATING

[75] Inventors: John R. Lovie, New Providence, N.J.; Gerardus A. Somers, Schayk; Jan J. M. Hendriks, Sint Oedenrode, both of Netherlands

[73] Assignee: OMI International Corporation, Warren, Mich.

[21] Appl. No.: 819,968

[22] Filed: Jan. 21, 1986

[30] Foreign Application Priority Data

Jan. 25, 1985 [GB] United Kingdom ..... 8501856

[51] Int. Cl.[4] ..... C25D 3/52; C25D 3/56

[52] U.S. Cl. ..... 204/44.6; 204/47

[58] Field of Search ..... 204/47, 44.6, 109; 106/1.24, 1.28

[56] References Cited

U.S. PATENT DOCUMENTS

| | | | |
|---|---|---|---|
| 2,469,727 | 5/1949 | Hoffman | 204/49 |
| 3,530,050 | 9/1970 | Hill et al. | 204/47 |
| 4,430,172 | 2/1984 | Brugger et al. | 204/44.6 |
| 4,487,665 | 12/1984 | Miscioscio | 204/47 |
| 4,545,869 | 10/1985 | Goldman | 204/47 |

FOREIGN PATENT DOCUMENTS

| | | | |
|---|---|---|---|
| 2133041 | 7/1984 | United Kingdom | 204/47 |

OTHER PUBLICATIONS

F. R. Hartley, "The Chemistry of Platinum and Palladium", p. 186, (1973).

Frederick G. Mann et al., J. Chem. Soc., pp. 1642–1652, (1935).

*Primary Examiner*—G. L. Kaplan

*Attorney, Agent, or Firm*—Richard P. Mueller

[57] ABSTRACT

The difficulties associated with electroplating palladium metal or alloy deposits from palladium diammino dichloride, palladium diamino dinitrite and palladium triammino sulphite baths can be avoided by plating from palladium baths containing oxalate. The palladium and oxalate may be in a single complex, such as palladium diamino oxalate, ($Pd(NH_3)_2C_2O_4$), palladium tetraamino oxalate ($Pd(NH_3)_4C_2O_4$) or an ammonium or alkali metal salt of palladium dioxalate ($M_2Pd(C_2O_4))_2$), where M represents an ammonium or alkali metal cation.

Alloying metal ions may also be present, as may an electrolyte, a brightener and/or a stress reducer.

15 Claims, No Drawings

PALLADIUM AND PALLADIUM ALLOY PLATING

This invention relates to a composition and a method for the plating of palladium in its pure metal form and alloyed with other metals.

The noble metal palladium has been plated on to a variety of substrates for several years for such functional uses as increasing conductivity at electrical switch contact elements and such decorative uses as providing a bright white deposit rivalling rhodium in quality. Palladium deposits have also been noted for their ability to withstand post-plating forming operations and maintain low contact resistance; further, they wear well and have good solderability properties.

Previously palladium has commonly been plated from compositions containing palladium diammine dichloride as disclosed in, for example, U.S. application No. 4098656. Compositions such as these, however, suffer from the disadvantage of undesirable anode reactions, which include the evolution of chlorine gas, hypochlorite and other oxidising species which can lead to the breakdown of organic addition agents (usually brighteners and stress reducers) which may be present and the passivation of substrates such as nickel on which the palladium metal or alloy may be desired to be deposited. The reactions that occur in such a system are as follows:

$$[Pd(NH_3)_2Cl_2] + 2NH_3 \longrightarrow [Pd(NH_3)_4]^{2+} + 2Cl^-$$

cathode $$[Pd(NH_3)_4]^{2+} + 2e^- \longrightarrow Pd + 4NH_3$$

anode $$2Cl^- \longrightarrow Cl_2 + 2e^-$$

but:

$$3Cl_2 + 2NH_3 + 6OH^- \longrightarrow N_2 + 6Cl^- \; 6H_2O$$

and:

$$NH_3 + H_2O \longrightarrow NH_4^+ + OH^-$$

so total is:

$$3Pd(NH_3)_2Cl_2 + 2NH_3 \longrightarrow 3Pd + N_2 + 6Cl^- + 6NH_4^+$$

It should be noticed that this scheme does not set out the intermediate reactions involving $OCl^-$, $NH_2Cl$ and Pd(IV) species.

Another known palladium plating composition involves the use of palladium diammino dinitrite, as taught in, for example, U.S. application No. 4401527. Other disadvantages are associated with such compositions. These include the reaction of nitrite ion with ammonium ion to produce nitrogen gas and water. Control of nitrite ion concentration is therefore a problem. Further, although this is not such a significant disadvantage, a build up of both nitrate ion and ammonium ion occurs as the nitrite ions tend to be oxidised at the cathode. The reactions that occur in the palladium diammino dinitrite system are as follows:

$$[Pd(NH_3)_2(NO_2)_2] + 2NH_3 \longrightarrow [Pd(NH_3)_4]^{2+} + 2NO_2^-$$

-continued cathode:

$$[Pd(NH_3)_4]^{2+} + 2e^- \longrightarrow Pd + 4NH_3$$

anode:

$$NO_2^- + 2OH^- \longrightarrow H_2O + NO_3^- + 2e^-$$

in solution:

$$NH_3 + H_2O \longrightarrow NH_4^+ + OH^-$$

and:

$$NH_4^+ + NO_2^- \longrightarrow N_2 + 2H_2O$$

so total is:

$$[Pd(NH_3)_2(NO_2)_2] \longrightarrow Pd + H_2O + N_2 + NH_4^+ + NO_3^-$$

Palladium sulphite compositions have also been previously disclosed (see, for example U.S. application No. 3933602) although not so commonly used in the art. The reactions that occur in the sulphite system are as follows:

$$[Pd(NH_3)_3SO_3] + NH_3 \longrightarrow [Pd(NH_3)_4]^{2+} + SO_3^{2-}$$

cathode:

$$[Pd(NH_3)_4]^{2+} + 2e^- \longrightarrow Pd + 4NH_3$$

anode:

$$SO_3^{2-} + 2OH^- \longrightarrow SO_4^{2-} + H_2O + 2e^-$$

solution:

$$NH_3 + H_2O \longrightarrow NH_4^+ + OH^-$$

so total is:

$$[Pd(NH_3)_3SO_3] + H_2O \longrightarrow Pd + NH_3 + 2NH_4^+ + SO_4^{2-}$$

Disadvantages associated with sulphite baths include the difficulty of using a concentration of sulphite which is neither low nor high, as at these intermediate concentrations the palladium triammino sulphite complex tends to precipitate out of solution with an appropriate cation. This problem can theoretically be avoided by working at low sulphite concentrations, in which solubility is not a problem, or at high sulphite concentrations, in which the soluble palladium diammino disulphite complex ion is formed. But low sulphite concentrations are difficult to control as sulphite ions are broken down at the anode, and high sulphite concentrations can lead to an unacceptable amount of sulphur in the plated deposit: this results in poor corrosion resistance. Also, a build up of sulphate ions occurs.

In view of these difficulties with palladium diammino dinitrite and palladium triammino sulphite compositions, palladium diammino dichloride baths have remained the most widely used in the art.

It has now been found that it is possible to plate palladium from a composition whose anode reactions present less of a problem than palladium diammino dichloride compositions.

It has been discovered that if oxalic acid or oxalate ions (the two terms are used interchangeably in this specification unless the context requires otherwise) are present and are the most readily oxidisable species present, they will be oxidised at an insoluble anode with the evolution of carbon dioxide, carbonate ions or bicarbonate ions. This oxidation may be found to proceed with an electrochemical efficiency of virtually 100%, thus-effectively preventing the occurrence of other undesirable anode reactions.

According to a first aspect of the present invention, there is provided a palladium metal or palladium alloy plating composition comprising a source of palladium metal and a source of oxalate ions, and optionally a source of alloying metal ions. The concentration of palladium in the composition may broadly range from 1 g/l to 60 g/l or the limit of solubility, with a range of from 5 g/l to 30 g/l being preferred and a concentration of about 10 g/l being optional.

The alloying metal ions can be nickel, cobalt, silver or any other suitable alloying metal. When certain alloying ions are present, for example nickel and cobalt, a complexing agent is generally present to keep the ions in solution and prevent their precipitation by oxalate. An example of a complexing agent for nickel or cobalt is pyrophosphate. The concentration of alloying ions, added as for example a bath soluble salt, may range from 1 to 60 g/l or the limit of solubility, with a range of 5 to 30 g/l being preferred and a concentration of about 10 g/l being optimal.

The concentration of complexing agent to be used will depend on the concentration of alloying metal ions and the stoichiometry of the complex of the alloying metal and the complexing agent.

The concentration of oxalate or available oxalate in the composition may broadly range from 0 01 M to 2 M or to the limit of solubility, with a range of from 0.1 1M to 0.5 M being preferred and a concentration of about 0.25 M being optimal.

The source of oxalate ions may be an ammonium or alkali metal salt such as sodium oxalate or potassium oxalate or may be oxalic acid itself, and the source of palladium may be palladium tetraamino dinitrate or palladium diamino dinitrite or palladium diamine dichloride or any other palladium salt yielding a tetrammine palladium complex in the plating solution. Preferably not more than 5, 10 or 15% of the palladium is complexed to sulphite moities.

But it is particularly preferred to combine the source of palladium and the source of oxalate ions as a single entity. It has been found that if the palladium is added as an oxalate complex or as a complex which yields oxalate ions in the working aqueous composition (for example by dissolution or hydrolysis), then a further advantage becomes apparent. This is that no appreciable build up of salt occurs in the solution apart from the establishment of equilibrium concentrations of ammonium carbonate and ammonium bicarbonate, which are slowly but steadily lost to the atmosphere as ammonia and carbon dioxide. The reactions that occur are, in one embodiment:

$$[Pd(NH_3)_2C_2O_4] + 2NH_3 \longrightarrow [Pd(NH_3)_4]^{2+} + C_2O_4^{2-}$$

cathode:

$$[Pd(NH_3)_4]^{2+} + 2e^- \longrightarrow Pd + 4NH_3$$

anode:

$$C_2O_4^{2-} \longrightarrow 2CO_2 + 2e^-$$

so total is:

$$[Pd(NH_3)_2C_2O_4] \longrightarrow Pd + 2NH_3 + 2CO_2$$

The nature of these reactions is such that the solution is essentially self buffering, so that less pH buffering salts are needed than might otherwise be required.

In this preferred aspect of the invention, the palladium may be added as palladium diamino oxalate ($Pd(NH_3)_2C_2O_4$) palladium tetraamino oxalate ($Pd(NH_3)_4C_2O_4$), or an ammonium or alkali metal salt of palladium dioxalate ($M_2Pd(C_2O_4)_2$), where M represents an ammonium or alkali metal cation. Of these, the tetrammino oxalate salt is preferred because of its improved light-stability resulting from the fact that no oxalate moities are complexed to the palladium atom.

The composition may also contain an electrolyte, such as disodium hydrogen phosphate, present in an effective amount up to the limit of solubility in the bath. From 10 to 200 g/l electrolyte may be present, for example from 50 to 150 g/l, typically 100 g/l.

The composition may also contain stress reducers and/or brighteners in effective amounts. Stress reducers and brighteners which have been found to be effective include those generally used in nickel plating systems. Many acceptable stress reducers contain sulphur, for example sulphonates such as sodium allyl sulphonate and sodium orthobenzaldehyde sulphonate. Saccharin is also an acceptable stress reducer. For brighteners, any of the Class I or Class II nickel brighteners, which are generally unsaturated, can be used. Brighteners which are aldehydes or are alkenically or alkynically unsaturated are suitable.

The pH of the bath will typically range from 6 to 9, with from 6.5 to 8 being the preferred range and 7 or 7.5 being optional.

According to a second aspect of the invention, there is provided a method of plating palladium metal or palladium alloy on a substrate, the method comprising contacting the substrate with a compositipn comprising a source of palladium, a source of oxalate ions and optionally a source of alloying metal ions and cathodically electrifying the substrate.

Such a method can be used to deposit palladium in thicknesses of 0.1 to 10 microns, preferably between 0.2 and 5 microns, depending on the application, typically between 0.5 and 2.5 for such applications as separable connectors for the electronics industry.

Plating is preferably carried out at a temperature of from 20° to 70° C., preferably from 30° to 70° C. with about 50° C. being preferred.

The current density at which the method is carried out can vary widely, for example from 0.1 to 200 ASD, preferably from 1 to 100 ASD and typically, for low-speed operations, from 2 to 20 ASD. The plating rate will clearly depend on the current density, but it has been found that rates in the order of 1 micron per minute are obtainable at current densities at 4 or 5 ASD.

The nature of the anode used is not believed to be particularly critical. Anodes such as those formed of (a) a noble metal coated in a readily passivated substrate (for example, platinised titanium), (b) pure noble metal, for example pure platinum (these anodes are particularly suitable as nozzles in jet plating), (c) carbon or (d) stainless steel may be found to be suitable.

Other preferred features of the second aspect of the invention are as for the first aspect *mutatis mutandis.*

A third aspect of the invention involves replenishing palladium or palladium alloy plating compositions with a palladium oxalate complex or a palladium complex which yields oxalate ions in the working aqueous composition and according to a fourth aspect of the invention there is provided a palladium-plated or palladium alloy-plated substrate whenever plated by means of a composition in accordance with the first aspect of the invention or by a method according to the second aspect.

The following examples illustrate the invention.

EXAMPLE 1

An aqueous 500 ml plating composition was made up with the following ingredients:

| | |
|---|---|
| Pd as $[Pd(NH_3)_2C_2O_4]$ | 10 g/l |
| $(NH_4)_2HPO_4$ | 100 g/l |
| saccharin | 1 g/l |
| sodium allyl sulphonate | 3 g/l |
| sufficient ammonia solution to adjust pH to | 7.5 |

A platinised titanium anode was immersed in the composition and a 0.5 $dm^2$ nickel-plated brass test panel was immersed as the cathode. Plating was carried out at a temperature of 50° C. for 4 minutes. The current density was 3 $A/dm^2$. During plating, the composition was agitated moderately by means of a magnetic stirrer. A 4 micron thick fully bright deposit was obtained. No apparently undesirable anode reactions took place during the plating process.

EXAMPLE 2

An aqueous 500 ml plating composition was made up with the following ingredients:

| | |
|---|---|
| Pd as $PD(NH_3)_4(NO_3)_2$ | 10 g/l |
| Ammonium oxalate | 30 g/l |
| Sodium orthobenzaldehyde sulphonate | 1 g/l |
| Butyne-1-4 diol | 100 mg/l |
| Sufficient ammonia solution to adjust the pH to | 7.0 |

A platinised titanium anode was immersed in the composition and a 0.5 $dm^2$ nickel-plated brass test panel was immersed as the cathode. Plating was carried out at a temperature of 50° C. for 4 minutes. The current density was 4 $A/dm^2$. During plating, the composition was agitated moderately by means of a magnetic stirrer. A 3 micron thick fully bright deposit was obtained. No apparently undesirable anode reactions took place during the plating process.

EXAMPLE 3

An aqueous 500 ml plating composition was made up with the following ingredients:

| | |
|---|---|
| Pd as $Pd(NH_3)_4(NO_3)_2$ | 10 g/l |
| Ni as $NiSO_4\ 7H_2O$ | 5 g/l |
| tetrapotassium pyrophosphate | 100 g/l |
| oxalic acid dihydrate | 30 g/l |
| sodium orthobenzaldehyde sulphonate | 5 g/l |
| sufficient ammonia solution to adjust pH to | 8.0 |

A platinised titanium anode was immersed in the composition and a 0.5 $dm^2$ brass test panel, the reverse side of which was masked off with suitable adhesive tape, was immersed as the cathode. Plating was carried out at a temperature of 60° C. for 20 minutes. The current density was 4 $A/dm^2$. During plating, the composition was agitated moderately by means of a magnetic stirrer. On removal of the adhesive tape and dissolution of the brass in a solution of 100 ml/l $H_2SO_4$ and 100 ml $H_2O_2$ (35%) in water, a 15 $\mu m$ thick smooth semi bright foil was obtained, which analysis revealed to contain 98% Pd and 2% Ni. No apparently undesirable anode reactions took place during the plating process.

What is claimed is:

1. A method of electroplating palladium metal or palladium alloy on a substrate which comprises contacting the substrate to be plated with an aqueous electroplating composition comprising a source of palladium metal, a source of oxalate ions and, optionally, a source of alloying metal ions wherein, the source of the palladium metal and the source of oxalate ions are added together to the composition in the form of a complex selected from the group consisting of palladium oxalate complexes and palladium complexes which yield oxalate ions in the aqueous electroplating composition, passing an electric current through the aqueous electroplating composition between an anode and the substrate to be plated as the cathode to cathodically electrify said substrate and cause the electrodeposition of a palladium containing layer thereon.

2. The method as claimed in claim 1, wherein palladium is plated to a thickness of from 0.1 to 10 microns.

3. The method as claimed in claim 1, wherein plating is carried out at a current density of from 1 to 100 ASD.

4. The method as claimed in claim 1, wherein the concentration of palladium in the composition ranges from 5 g/l to 30 g/l.

5. The method as claimed in claim 1, wherein alloying metal ions, selected from the group of nickel, cobalt and silver are present in the composition.

6. The method as claimed in claim 5, wherein the alloying metal ions are present at a concentration of from 5 g/l to 30 g/l.

7. The method as claimed in claim 5, wherein a complexing agent for the alloying metal ions is present in the composition.

8. The method as claimed in claim 1, wherein the concentration of available oxalate in the composition ranges from 0.1 M to 5 M.

9. The method as claimed in claim 1, wherein the palladium oxalate complex in the composition is selected from the group consisting of palladium diammino oxalate and palladium tetrammino oxalate.

10. The method as claimed in claim 1, wherein the palladium oxalate complex in the composition is selected from the group consisting of ammonium and alkali metal salts of palladium dioxalate.

11. The method as claimed in claim 1 wherein the composition also contains an electrolyte.

12. The method as claimed in claim 11 in which the electrolyte is disodium hydrogen phosphate.

13. The method as claimed in claim 12 wherein the electrolyte is present at a concentration of from 50 to 150 g/l.

14. The method as claimed in claim 1, wherein the composition further contains as a bath additive stress reducer, brightener or mixtures thereof.

15. The method as claimed in claim 1 wherein the pH of said composition is from 6.5 to 8.

* * * * *